United States Patent [19]

Béduchaud et al.

[11] Patent Number: 4,514,078

[45] Date of Patent: Apr. 30, 1985

[54] INDIRECT ELECTROSTATIC PRINTER

[75] Inventors: Michel Béduchaud, Villebon sur Yvette; Patrice Playe, Houilles, both of France

[73] Assignee: Compagnie Industrielle des Telecommunications Cit-Alcatel, Paris, France

[21] Appl. No.: 482,084

[22] Filed: Apr. 4, 1983

[30] Foreign Application Priority Data

Apr. 2, 1982 [FR] France ..... 82 05726

[51] Int. Cl.[3] ..... G03G 15/00

[52] U.S. Cl. ..... 355/3 BE; 355/3 TE; 355/3 TR; 355/12

[58] Field of Search ..... 101/141, 1, DIG. 13; 118/653; 346/155, 153.1; 430/126; 355/3 BE, 3 TE, 3 TR, 12

[56] References Cited

U.S. PATENT DOCUMENTS

| | | | |
|---|---|---|---|
| 2,761,416 | 9/1956 | Carlson | 346/153.1 X |
| 3,194,674 | 7/1965 | Sakurai . | |
| 3,198,648 | 8/1965 | Trimbur | 346/155 X |
| 3,739,087 | 6/1973 | Metcalfe et al. . | |
| 4,286,032 | 8/1981 | Kawasaki et al. . | |

FOREIGN PATENT DOCUMENTS

| | | | |
|---|---|---|---|
| 1132861 | 7/1962 | Fed. Rep. of Germany . | |
| 2917005 | 4/1979 | Fed. Rep. of Germany . | |
| 0012618 | 2/1978 | Japan | 346/153.1 |
| 1064980 | 4/1967 | United Kingdom . | |

OTHER PUBLICATIONS

257 Automation, vol. 22, No. 6, Jun. 1975, "Keeping Current News and Trends", p. 6.

*Primary Examiner*—Ulysses Weldon

*Attorney, Agent, or Firm*—Sughrue, Mion, Zinn, Macpeak & Seas

[57] ABSTRACT

An indirect electrostatic printer is characterized in that the intermediate medium in the form of a dielectric tape (1) is mounted in an open loop defined by a supply reel (2), an auxiliary roller (4) over which its path doubles back and a take up reel (3), and in that said auxiliary roller (4) and an associated pressure roller (14) define a combined station (7) for simultaneously transferring and fixing the image on the final medium which is in the form of individual sheets (8), and said auxiliary roller and said pressure roller constituting, together with said tape (1), means for conveying the sheets to a copy delivery station (15).

4 Claims, 1 Drawing Figure

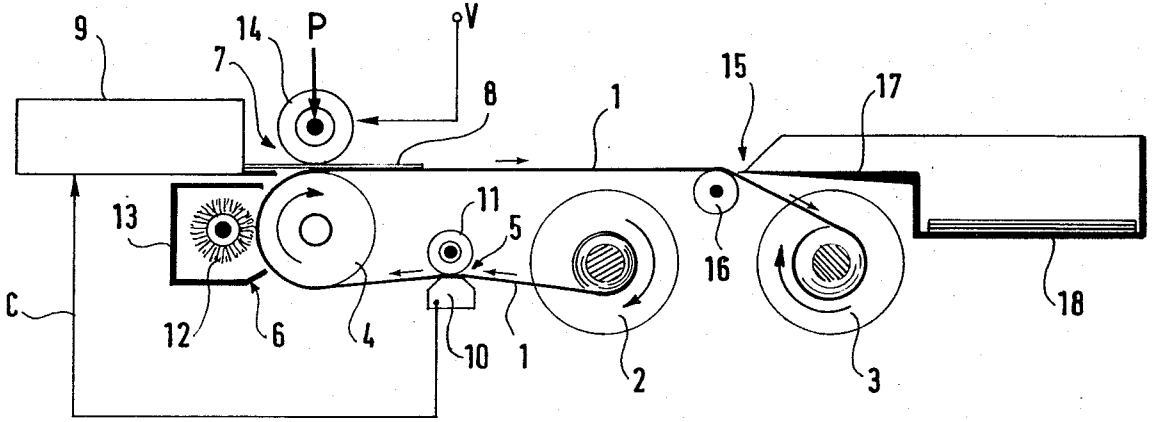
18
17
3
15
16
2
1
1
5
11
10
V
8
4
P
14
7
6
12
13
9
C

INDIRECT ELECTROSTATIC PRINTER

The present invention relates to electrostatic printers, and more particularly to such printers which form an electrostatic latent image on an intermediate medium and which then develop the image and before transferring it to a final medium which is preferably plain paper.

BACKGROUND OF THE INVENTION

In commonly used electrostatic printers, also known as direct electrostatic printers, the image is printed directly onto a special final medium which comprises a conductive substrate on which a dielectric layer a few micrometers thick is deposited. The image printing process is performed in several successive operations taking place in distinct stations for each operation. Essentially the process consists in three successive stages: a printing stage which takes place in a printing station and comprises creating an electrostatic latent image on the special medium by discharging ions thereon from a print head having multiple miniature electrodes arranged in some suitable pattern such as one or more rows or a matrix, said discharge passing through the air in a gap between the electrodes and the dielectric layer; then a developer stage which takes place in an image developer station and comprises inking the latent image with a deposit of fine particles of magnetic powder or ink using a magnetic brush or other inking means; and finally a fixing stage which takes place in an image fixing station and comprises fixing the image by application of heat, eg. by passing the medium through an oven.

Electrostatic printers of the type with which the present invention is concerned and known as indirect electrostatic printers also exist. In these printers, the electrostatic latent image is generated on an intermediate medium, is developed thereon, and is then transferred to a final medium, usually paper, on which it is fixed. The various printing stages or operations in an indirect electrostatic printer are performed by means analogous to those used in the successive stations of a direct electrostatic printer, with a transfer stage in which ink is transferred from the intermediate medium to the final medium being inserted in between the developer stage and the fixing stage. The transfer advantageously takes place in an image transfer station, by pressing the final medium of plain paper closely against the inked latent image on the intermediate medium, and is generally accompanied by the application of a suitable voltage to a transfer electrode disposed behind the final medium for enhancing said transfer.

In an indirect electrostatic printer, the intermediate medium may be constituted by a conductive substrate on which a thin dielectric layer is deposited, or alternatively, it may be constituted by a simple film of dielectric material.

Thus. U.S. Pat. No. 3,198,648 describes an electrostatic printing process in which for reasons of cost, a dielectric band is used as the intermediate medium and plain paper is used as the final medium. In the printer, the dielectric band is mounted in an endless loop passing over two rollers. One of the rollers is electrically conductive and constitutes a counter-electrode which is associated with a multiple electrode print head for printing the latent image on the outer surface of the dielectric band as it passes over the counter-electrode roller. The image is then inked by an image developer system located close to said counter-electrode roller.

At the other roller over which the dielectric band passes, there is a pressure roller which presses the final plain paper closely to the previously inked image to transfer the particles of ink onto the paper where they are subsequently fixed by applying greater pressure than is used to transfer the image. Finally the dielectric band is cleaned and electrostatically discharged after the image has been transferred therefrom in readiness to receive a further image as it passes over the counter-electrode roller.

Preferred embodiment of the present invention provide an indirect electrostatic printer using a flexible intermediate medium, such as a tape of dielectric material, which is of simple and compact structure, and which delivers printed images on sheets of a final medium such as paper.

SUMMARY OF THE INVENTION

The present invention therefore provides an indirect electrostatic printer using an intermediate image medium in the form of a flexible dielectric tape, the printer comprising a printing station for printing an electrostatic latent image on the intermediate medium, a developer station for developing the image on the intermediate medium, and a combined transfer and fixing station for both transferring the image onto a final medium and for fixing the image thereto, said dielectric tape being mounted in an open loop path running from a supply reel, round an auxiliary roller over which its path is folded and on to a take up reel, said open loop path running through all three of said stations in succession with at least one of said reels and roller serving to drive the tape, said auxiliary roller being associated with a pressure roller to define said combined transfer and fixing station for simultaneously transferring and fixing the image on the final medium, said final medium being in the form of individual sheets which are driven through said combined transfer and fixing station by said auxiliary roller and said pressure roller and then being conveyed by said dielectric tape to a copy delivery station.

BRIEF DESCRIPTION OF THE DRAWING

An embodiment of the invention is described by of example with reference to the sole FIGURE of the accompanying drawing which is a diagram showing the organization of a compact electrostatic printer for delivering images on plain paper.

MORE DETAILED DESCRIPTION

The indirect electrostatic printer includes an intermediate image medium 1 constitued by a long flexible tape of dielectric material taken from a supply reel 2 and wound onto a take up reel 3. In between the two reels 2 and 3, the tape 1 follows an open loop path via an auxiliary roller 4 which folds the path followed by the tape 1 as it is driven from the supply reel 2 to the take up reel 3.

The flexible tape 1 is advantageously constituted by a thin dielectric film which is at least as wide as the image to to be printed and delivered.

As it travels along the open loop path from the supply reel 2, round the auxiliary roller 4 and on to the take up reel 3, the tape 1 passes successively through an electrostatic print station 5 disposed between the supply reel and the auxiliary roller, through an image developer station 6 disposed in the immediate vicinity of the auxiliary roller, and through a combined transfer and fixing station 7 which is supplied with individual sheets of plain paper 8 by an adjacent paper feeder 9.

The printing station 5 is of conventional type and comprises a print head 10 which is constituted by a plurality of individual electrodes arranged in one or more rows or in a matrix and which disposed facing the outside surface of the open loop tape 1, and an associated counter-electrode constituted by a conductive roller 11 which is disposed in contact with the inside surface of the tape 1. The electrostatic latent image is thus printed on the outside surface of the tape as a function of control signals applied in succession to individual electrodes of the head by a suitable control circuit (not shown).

Since the surface of the tape 1 is substantially perfectly smooth, the print head 10 further includes means for spacing the electrodes from the outside surface of the tape 1 to ensure the presence of the film of air which is necessary for the ionic discharge by which the latent image is printed. The print head 10 may therefore be constituted by a known type of print head for performing this need, or else it may be constituted by the print head which is the subject matter of the applicant's co-pending patent application entitled "An electrostatic print head".

The developer stage 6 is known per se. It comprises a magnetic brush 12 using a one- or two-component powder taken from a tank 13 to ink the previously generated latent image. To reduce bulk, this station is advantageously disposed in the immediate vicinity of the auxiliary roller 4 just beyond the end of the open loop of tape 1.

The transfer and fixing station 7 for transferring the image from the tape 1 to the final plain paper medium is constituted by the auxiliary roller 4 and by a pressure roller 14 which receives an external pressure P pressing it against the tape 1 where it is still supported by the auxiliary roller 4. The paper feeder 9 for feeding individual sheets of paper has its outlet disposed tangentially to the rollers 4 and 14, and feeds the image transfer and fixing station with sheets of paper in synchronism with the generation of latent images by the printing station 5, as symbolised by a control link C between said stations. The feeder 9 is also known per se and is therefore not described in detail; only the link C from the printing station is specific to the present application, and it serves simply to time the moment when a sheet 8 leaves the feeder to be taken up directly by the rollers 4 and 14.

The ink deposited on the latent image then passing between the rollers 4 and 14 is thus transferred and simultaneously fixed to the sheet of paper 8 which is at that time pressed against the tape while being driven along with the tape.

In the transfer and fixing station 7, the rollers 4 and 14 may both be metal rollers which are cooled and which apply pressure only to the dielectric tape 1 and the sheet of paper 8. Depending on the type of powder used for inking the image in the developer station 6, a potential difference may be set up between the rollers 4 and 14 to facilitate image transfer, and this is symbolised by a voltage V being applied to the roller 14.

In a variant, the metal rollers 4 and 14 may be heated by means of a lamp or a filament (not shown). Under such conditions, image fixing is improved and less pressure need be applied. Image transfer may be simultaneously improved by applying a potential difference between the rollers 4 and 14.

The sheets of paper 8 fed out onto the tape 1, first as the tape passes between the rollers 4 and 14, and then as it advances towards the take up reel 3, are thus conveyed towards a station 15 for delivering printed copies and located close to the take up spool 3. The delivery station 15 has a guide roller 16 in contact with the inside face of the tape which serves to deflect the end portion of the open loop path of the tape 1 just ahead of the take up reel so that successive sheets of paper 8 may be picked off the tape 1 by a skimmer 17 which then guides them to a tray 18 from which a user may take them.

The tape 1 is preferably driven by the auxiliary roller 4 and by the take up spool 3. The supply spool 2 should be mounted with a small amount of friction tending to keep the tape 1 sufficiently taut as it passes through the printing station 5. The auxiliary roller 4 and the pressure roller 14 which is mounted as an idler roller with a pressure P being applied to its shaft constitute pinch means for taking individual sheets 8 from the sheet feeder, and in association with the tape 1, they serve to convey the sheets of paper to the tray 18. Although not shown, it is advantageous for the rollers 4 and 14 to be coated with material for providing a suitable co-efficient of friction between the rollers and the tape or the paper as the case may be, and for flexibly compensating for small faults in the machining of the surfaces of the rollers.

In this printer, the use of a long dielectric tape moving along an open loop path from a supply reel to take up reel makes it possible to provide a printer whose structure is both simple and compact. This is due in the main to the use of a single station for transferring the image to paper and then fixing it there, to the use of a common drive for the paper and for the tape provided by a single combination of a pressure roller 14 associated with an auxiliary roller 4 over which the tape path is folded, and to the fact that an intermediate medium cleaning station is dispensed with since the film is used once and is then taken up on the take up reel 3. While it is conceivable that such a used film could be cleaned outside the printer and recycled, in practice, it is more likely to be discarded and replaced by a new film.

We claim:

1. An indirect electrostatic printer using an intermediate image medium, said printer comprising:

a printing station for printing an electrostatic latent image on the intermediate medium, a developer station for developing the image on the intermediate medium, a combined transfer and fixing station for both transferring the image onto a final medium and for fixing the image thereon, and a coply delivery station, the improvement wherein said intermediate image medium comprises a flexible dielectric tape and means for mounting said tape in an open loop path running in sequence from a supply reel as a lower run, around an auxiliary roller from bottom to top over which its path is folded forming a top run passing across and above the supply reel and onto a take up reel, said open loop path running through all three of said stations in succession, means for driving said tape comprising at least one of said take up reel and said auxiliary roller, a pressure roller operatively associated with said auxiliary roller to define said combined transfer and fixing station for simultaneously transferring and fixing the image on the final medium, and means for supplying said final medium in the form of individual sheets to said combined transfer and fixing station between the nip of said pressure roller and said dielectric tape while in contact with the periphery of said auxiliary roller for driving said sheets by said auxiliary roller and said pressure roller onto the top run of said dielectric tape for conveying said sheets sequentially to said copy delivery station.

2. An electrostatic printer according to claim 1, wherein said supply means includes an individual sheet feeder mounted close to said pressure and auxiliary rollers, and means for controlling said feeder being in synchronism with said latent image printing station in order to feed sheets to the combined image transfer and fixing station.

3. A printer according to claim 1, wherein said pressure and auxiliary rollers are each covered in a layer of material for matching coefficients of friction between the rollers, the sheets of the final medium, and the dielectric tape.

4. A printer according to claim 1 wherein said copy delivery station comprises a guide roller which deflects the end portion of the open loop path dielectric tape by pressing against its inner face, and a skimmer mounted substantially in the continuation of said path where the path is deflected to receive the printed copies as successively conveyed by the tape.

* * * * *